US006936803B2

(12) United States Patent
I et al.

(10) Patent No.: US 6,936,803 B2
(45) Date of Patent: Aug. 30, 2005

(54) INVERTER CIRCUIT OF MICROWAVE OVEN

(75) Inventors: Min Gi I, Changwon-si (KR); Sung Jin Han, Seoul (KR); Dong Myung Shin, Gwangmyeong-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/732,413

(22) Filed: Dec. 11, 2003

(65) Prior Publication Data

US 2004/0149744 A1 Aug. 5, 2004

(30) Foreign Application Priority Data

Dec. 30, 2002 (KR) ..... 10-2002-0087116

(51) Int. Cl.[7] ..... H05B 6/68
(52) U.S. Cl. ..... 219/716; 363/98
(58) Field of Search ..... 219/716, 718, 219/710, 736, 715, 721, 723, 717, 506; 363/132, 96, 97, 98, 49, 50, 95, 76; 323/223, 24, 283; 331/86–87

(56) References Cited

U.S. PATENT DOCUMENTS 4,420,668 A * 12/1983 Larson et al. ..... 219/718
4,920,246 A * 4/1990 Aoki ..... 219/716
5,124,518 A * 6/1992 Lee ..... 219/718
5,451,750 A * 9/1995 An ..... 219/716
5,490,450 A * 2/1996 Lee ..... 99/337

* cited by examiner

*Primary Examiner*—Quang T. Van
(74) *Attorney, Agent, or Firm*—Fleshner & Kim,LLP

(57) ABSTRACT

An inverter circuit of a microwave oven employs a technique which decreases the unit manufacturing cost of production and controls an output of a magnetron correctly. The invert circuit includes a micom outputting a reference voltage preset by a user; an input current detector converting a current provided from the power source to a voltage level; and comparator comparing an output signal of the input current detector with the reference voltage; an integrator increasing or decreasing a level of an output signal for the comparator a trigger circuit connected to the high voltage transformer, and generating a trigger signal; and a PWM controller receiving an output signal of the integrator and an output al of the trigger circuit, for controlling drive of the magnetron.

26 Claims, 4 Drawing Sheets

INVERTER CIRCUIT OF MICROWAVE OVEN

This application claims the benefit of the Korean Application No. P2002-0087116 filed on Dec. 30, 2002, which is hereby incorporated by reference.

BACKGROUND OF THE INVENTION

1. Field of the Invention

The present invention relates to a microwave oven, and more particularly, to an inverter circuit of a microwave oven driving a magnetron in an inverter system.

2. Background of the Related Art

Home appliances for cooking comprise a gas range, a gas oven range, a microwave oven and an electric oven. Among the home appliances for cooking, the microwave oven heats an object provided in a cavity with a microwave oscillated in a magnetron MGT therein. Generally, the microwave oven uses an inverter circuit to control drive of the magnetron.

An inverter circuit of a microwave oven according to the related art will be described as follows.

As shown in FIG. 1, the inverter circuit of the microwave oven according to the related art is provided with a rectifying circuit part 2 for rectifying an AC power from a power source 1 to be connected to both sides of the power source 1. Then, both output terminals of the rectifying circuit part 2 are respectively connected to a primary side coil of a high voltage transformer HVT (omission of a reference number) and a switching device IGBT 4, and a secondary side coil of the HVT is connected to a magnetron 3.

Also, an input current detecting part 5 is connected to one end of the power source 1 to convert the current outputted from the power source 1 to a voltage level and to provide the voltage level to a micom 6. The micom 6 detects the voltage level outputted from the input current detecting part 5, and controls turning on/off operations of first, second and third photo couplers PC1, PC2 and PC3 according to the detected voltage level and a preset reference voltage by a user. That is, the micom 6 turns on only first photo coupler PC1 according to the detected voltage level and the preset reference voltage, or turns on all of the first, second and third photo couplers PC1, PC2 and PC3. That is, the power is divided by the first, second and third photo couplers PC1, PC2 and PC3 to make the voltage level of the micom 6 corresponding to the voltage level of the inverter circuit.

According to operations of the first, second and third photo couplers PC1, PC2 and PC3, the voltage divided and outputted by first, second, third and fourth resistances R1, R2, R3 and R4 is inputted to a reference level output part 7. Then, the reference level output part 7 outputs a reference voltage of a predetermined DC level corresponding to the voltage outputted from the first, second, third and fourth resistances R1, R2, R3 and R4.

In a trigger circuit part 8 connected to lower and upper sides of the primary side coil of the HVT, when a voltage applied to the upper side of the primary side coil of the HVT is higher than a voltage applied to the lower side of the primary side coil of the HVT, the trigger circuit part 8 outputs a trigger signal. Also, a triangular wave output part 9 is connected to the trigger circuit part 8 to generate a triangular wave according to the trigger signal outputted from the trigger circuit part 8.

A comparing part 10 is connected to the triangular wave output part 9 and the reference level output part 7. The comparing part 10 receives the reference voltage outputted from the reference level output part 7 through a non-inversion (+) terminal, and receives the triangular wave generated in the triangular wave output part 9 through an inversion (−) terminal. At this time, if the input of the non-inversion (+) terminal is higher than the input of the inversion (−) terminal, to be in a case that the reference voltage is higher than the triangular wave, a high signal is outputted. Then, the signal outputted from the comparing part 10 is provided to the switching device IGBT through a driving part 1, to drive the switching device IGBT 4 for turning on/off operations of the magnetron 3.

The signal outputted from the comparing part 10 is controlled in turning on/off of the first, second and third photo couplers PC1, PC2 and PC3. For example, in case all the first, second and third photo couplers PC1, PC2 and PC3 are turned on, the reference voltage outputted from the reference level output part 7 is high, so that the a width (Ton) of a driving signal of the switching device 4 outputted from the comparing part 10 becomes wide ((A) of FIG. 2).

If the first and second photo couplers PC1 and PC2 are turned on, the width of the driving signal outputted from the comparing part 10 is shown as (B) of FIG. 2. Meanwhile, if only first photo coupler PC1 is turned on, the width of the driving signal outputted from the comparing part 10 is shown as (C) of FIG. 2.

However, the inverter circuit of the microwave oven according to the related art has the following disadvantages.

First, the inverter circuit of the microwave oven according to the related art requires the plurality of photo couplers as means of controlling the output, so that the unit manufacturing cost of production (microwave oven) is increased in that the photo coupler is expensive device.

Also, the micom receives the output (present current) of the input current detecting part by feedback, and controls the output of the inverter circuit, whereby a program processing time of the micom is slow, and it is difficult to control the inverter circuit correctly.

SUMMARY OF THE INVENTION

Accordingly, the present invention is directed to an inverter circuit of a microwave oven that substantially obviates one or more of the problems due to limitations and disadvantages of the related art.

An object of the present invention is to provide an inverter circuit of a microwave oven provided with inexpensive devices, for decreasing the unit manufacturing cost of production.

Another object of the present invention is to provide an inverter circuit of a microwave oven for driving the microwave oven stably by controlling an output of a magnetron correctly.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an inverter circuit of a microwave oven, having a power source and a magnetron MGT, according to the present invention is provided with a high voltage transformer HVT providing a high voltage to the magnetron; a micom outputting a reference voltage preset by a user; an input current detector converting a current provided from the power source to a voltage level; a comparator comparing an output signal of the input current detector with the reference voltage; an integrator increasing or decreasing a level of an output signal of the comparator; a trigger circuit connected to the high voltage transformer, and generating a trigger signal; and a PWM controller receiving an output signal of the integrator and an output signal of the trigger circuit, for controlling drive of the magnetron.

Also, the inverter circuit further includes an inverter state detector for receiving the output signal of the input current detector, detecting whether a power provided from the power source is in a normal state, and informing the micom about the state of the power. At this time, the inverter state detector includes a comparator comparing the output signal of the input current detector with the reference voltage; and a photo coupler being driven according to the output signal of the comparator.

Also, the inverter circuit further includes a D/A converter for converting the reference voltage outputted from the micom to an analog signal, and providing the analog signal to the comparator. At this time, the D/A converter includes a photo coupler receiving the reference voltage from the micom; first and second transistors being connected in series, and being turned on by the photo coupler; and a capacitor charging a voltage by the first and second transistors, and providing the voltage to the comparator.

The PWM controller generates a triangular wave signal by the trigger signal, and compares the level of the triangular wave signal with the level of the output signal of the integrator. The PWM controller outputs a high level signal for a period in which the level of the output signal of the integrator is higher than the level of the triangular wave signal.

In another aspect, an inverter circuit of a microwave oven, having a power source and a magnetron MGT, is provided with a high voltage transformer having a primary side coil connected to the power source, and a secondary side coil connected to the magnetron; a switching device between the power source and the primary side coil of the high voltage transformer; a micom outputting a pulse width modulation PWM signal according to a preset reference voltage; a D/A converter converting the PWM signal to a digital analog signal; an input current detector converting a current provided from the power source to a voltage level; a comparator comparing an output signal of the input current detector with an output signal of the D/A converter; an integrator increasing or decreasing a DC level according to a comparison result in the comparator; a trigger circuit connected to the primary side coil of the high voltage transformer, and generating a trigger signal; and a PWM controller generating a triangular wave signal internally according to the trigger signal, and controlling the switching device according to the triangular wave signal and the level of an output signal of the integrator.

Also, the inverter circuit further includes an inverter state detector for receiving the output signal of the input current detector, detecting whether a power provided from the power source is in a normal state, and informing the micom about the state of the power. At this time, the inverter state detector includes a comparator comparing the output signal of the input current detector with the preset reference voltage; and a photo coupler being driven by the output signal of the comparator.

The D/A converter includes a photo coupler receiving the PWM signal from the micom; first and second transistors being connected in series, and being turned on by the photo coupler; and a capacitor charging a voltage by the first and second transistors, and providing the voltage to the comparator.

At this time, the integrator increases the DC level when the level of the output signal of the input current detector is lower than the level of the output signal of the D/A converter, and decreases the DC level when the level of the output signal of the input current detector is higher than the level of the output signal of the D/A converter.

Also, the trigger circuit is connected to lower and upper sides of the primary side coil of the high voltage transformer. At this time, the trigger circuit generates the trigger signal in case a voltage applied to the upper side of the primary side coil is higher than a voltage applied to the lower side of the primary side coil.

Also, the PWM controller outputs a high level signal for a period in which the level of the output signal of the integrator is higher than the level of the triangular wave signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENT

Reference will now be made in detail to the preferred embodiments of the present invention, examples of which are illustrated in the accompanying drawings.

Figure 1:
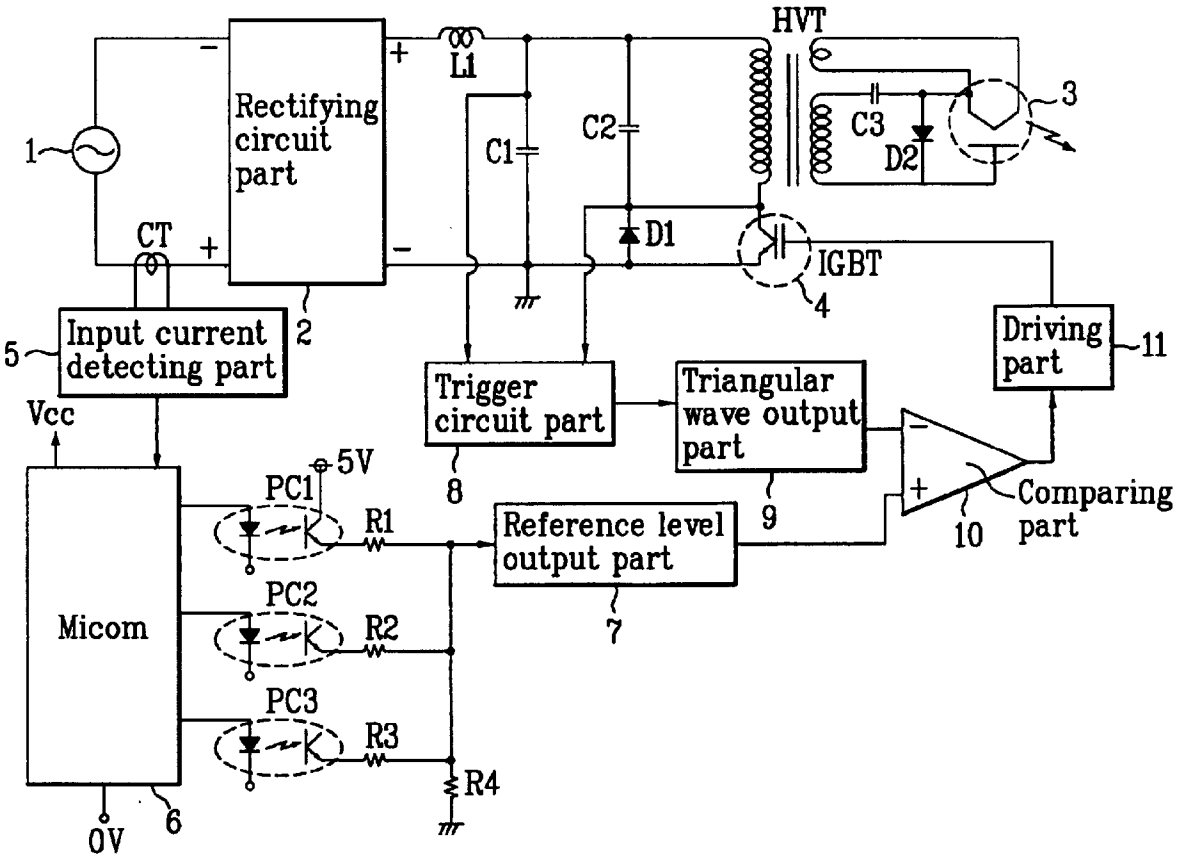
FIG. 1 Prior Art
FIG. 1 illustrates an inverter circuit of a microwave oven according to the related art.
Figure 2:
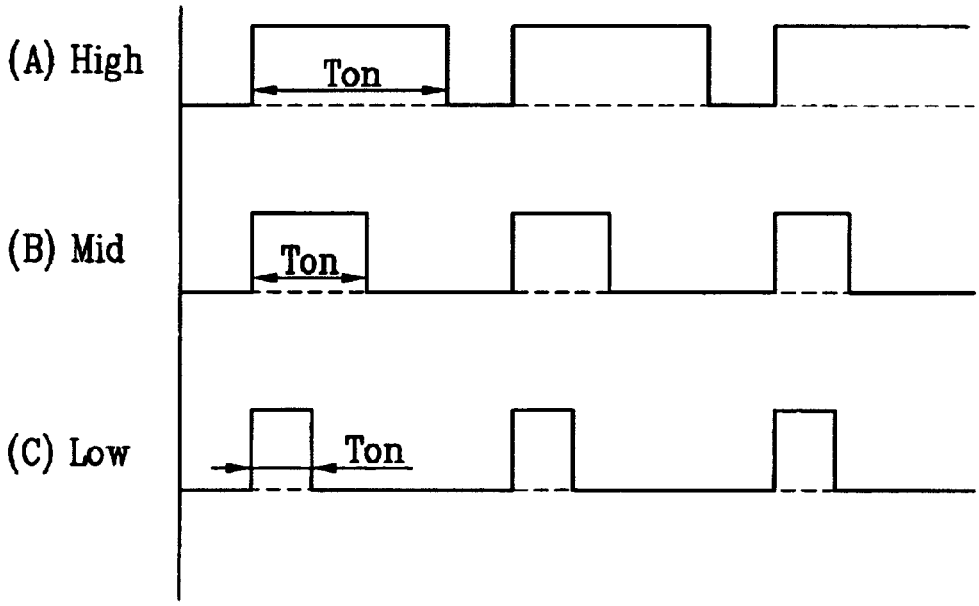
FIG. 2 Prior Art
FIG. 2 illustrates a waveform diagram for a magnetron driving signal in an inverter circuit according to the related art.
Figure 3:
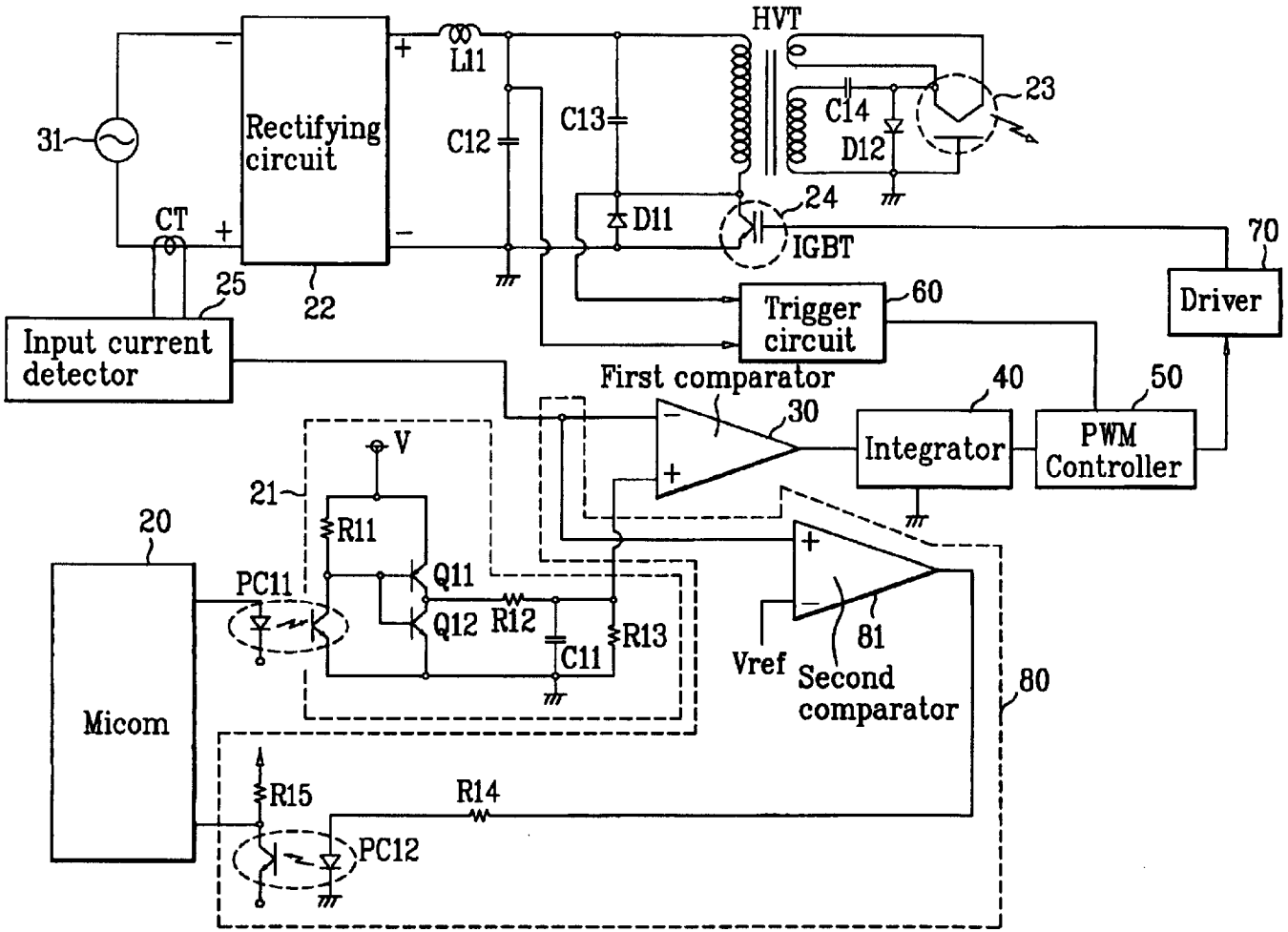
FIG. 3 illustrates an inverter circuit of a microwave oven according to the present invention.

FIG. 3 illustrates an inverter circuit of a microwave oven according to the present invention. Referring to FIG. 3, the inverter circuit for the microwave oven according to the present invention is provided with a rectifying circuit 22 for rectifying an AC power from a power source 31 to be connected to both sides of the power source 31. Then, both output terminals of the rectifying circuit 22 are respectively connected to a primary side coil of a high voltage transformer HVT (omission of a reference number) and a switching device IGBT 24. That is, a non-inversion (+) terminal of the rectifying circuit 22 is connected to an upper side of the primary side coil of the HVT, and an inversion (−) terminal of the rectifying circuit 22 is connected to the switching device 24.

Also, a secondary side coil of the HVT is connected to a magnetron 23, thereby providing a high voltage to the magnetron 23. Then, an input current detector 25 is connected to one end of the power source 31 to convert the current outputted from the power source 31 to a voltage level. A trigger circuit 60 is connected to lower and upper sides of the primary side coil of the HVT. At this time, the trigger circuit 60 outputs a trigger signal when a voltage applied to the upper side of the primary side coil is higher than a voltage applied to the lower side of the primary side coil.

A micom 20 outputs a digital pulse width modulation PWM signal according to a preset voltage by a user, and the micom 20 is connected to a D/A converter 21 to convert the PWM signal outputted from the micom 20 to an analog signal. At this time, the micom 20 transmits the PWM signal to the D/A converter 21 through one photo coupler PC11. That is, the PWM signal, an electric signal outputted from the micom 20, is converted to an optical signal by a light-emitting diode of the photo coupler, and then the optical signal is transmitted to a phototransistor. Subsequently, the phototransistor restores the optical signal to the electric signal.

The D/A converter 21 is provided with the photo coupler PC11 connected to a PWM signal output terminal of the micom 20 and being turned on when the PWM signal is high, first and second transistors Q11 and Q12 having bases connected to a collector of the photo coupler PC11 and being turned on sequentially when the photo coupler PC11 is turned on, and a first capacitor C11 having one end connected to each collector coupling point of the first and second transistors Q11 and Q12 and the other end connected to an emitter of the second transistor Q12, for outputting a voltage charged according to an turning-on operation of the first and second transistors Q11 and Q12.

Also, a first comparator 30 is connected to the input current detector 25 and the D/A converter 21. The first comparator 30 outputs a high signal in case a voltage level outputted from the input current detector 25 is lower than a voltage level outputted from the D/A converter 21, and outputs a low signal in case a voltage level outputted from the input current detector 25 is higher than a voltage level outputted from the D/A converter 21. Then, an integrator 40 is connected to a ground terminal with the first comparator 30 to control an output level according to a signal outputted from the first comparator 30.

A PWM controller 50 is connected to the trigger circuit 60 and the integrator 40. At this time, the PWM controller 50 generates a triangular wave signal internally according to a trigger signal outputted from the trigger circuit 60, and outputs high or low level signal according to a comparison result between the level of the triangular wave signal and the output level of the integrator 40. Also, a driver 70 is connected to the PWM controller 50, for turning on/off operation of the switching device 24 according to the signal outputted from the PWM controller 50. Furthermore, the switching device 24 controls an operation of the magnetron 23.

Also, the inverter circuit of the microwave oven according to the present invention further includes an inverter state detector 80 for detecting the state of the inverter circuit by receiving the voltage outputted from the input current detector 25. The inverter state detector 80 is provided with a second comparator 81 receiving a reference voltage and a voltage outputted from the input current detector 25, and a photo coupler PC12 transmitting the output from the second comparator 81 to the micom 20.

In the second comparator 81, the output signal of the input current detector 25, which is inputted to the inversion (−) terminal, is compared to the reference voltage inputted to the non-inversion (+) terminal. If the voltage outputted from the input current detector 25 is higher than the reference voltage, the second comparator 81 outputs a high signal. The photo coupler PC12 is turned on only in case the second comparator 81 outputs the high signal.

An operation of the inverter circuit of the microwave oven according to the present invention will be described in detail.

First, when providing the AC power from the power source 31, the rectifying circuit 22 rectifies the AC power, and outputs the rectified AC power to the primary side coil of the HVT. Then, if the user selects a particular function of the microwave oven such as a warming up or cooking mode, the micom 20 selects the preset voltage corresponding to the function selected by the user, and outputs the PWM signal according to the preset voltage.

In case the PWM signal is high, the photo coupler PC11 connected to the PWM output terminal of the micom 20 is turned on. At this time, the photo coupler PC11 is used for electrically connecting the micom 20 with the inverter circuit since the micom 20 and the inverter circuit have different potential levels.

If the photo coupler PC11 is turned on, the first and second transistors Q11 and Q12 are sequentially turned on, so that the voltage is charged in the first capacitor C11 for the turning-on state of the first and second transistors Q11 and Q12. Also, the voltage charged in the first capacitor C11 is inputted to the non-inversion (+) terminal of the first comparator 30. Like this, the voltage inputted to the first comparator 30 from the D/A converter 21 becomes the reference voltage of the first comparator 30.

The output signal of the D/A converter 21 is inputted to the non-inversion (+) terminal of the first comparator 30, simultaneously, the output signal of the input current detector 25 is inputted to the inversion (−) terminal of the first comparator 30. Also, the output signal of the input current detector 25 is the signal converting the current provided from the power source 31 to the voltage level.

After that, in the first comparator 30, the signal inputted to the inversion (−) terminal is compared to the signal inputted to the non-inversion (+) terminal. At this time, if the output voltage of the input current detector 25, which is inputted to the inversion (−) terminal, is lower than the reference voltage inputted to the non-inversion (+) terminal, the first comparator 30 outputs the high signal. Meanwhile, the output voltage of the input current detector 25, which is inputted to the inversion (−) terminal, is higher than the reference voltage inputted to the non-inversion (+) terminal, the first comparator 30 outputs the low signal.

The integrator 40 increases the DC output level in case the first comparator 30 outputs the high signal, and decreases the DC output level in case the first comparator 30 outputs the low signal. Also, in the trigger circuit 60 connected to the lower and upper sides of the primary side coil of the HVT, the voltage applied to the lower side of the primary side coil is compared to the voltage applied to the upper side of the primary side coil. If the voltage applied to the upper side of the primary side coil is higher than the voltage applied to the lower side of the primary side coil, the trigger circuit 60 generates the trigger signal.

Subsequently, the output signal of the integrator 40 and the output signal of the trigger circuit 60 are provided to the PWM controller 50. The PWM controller 50 generates the triangular wave internally when the trigger signal is inputted, and outputs the high or low level signal according to the comparison result between the output signal level of the integrator 40 and the level of the triangular wave signal.

Figure 4:
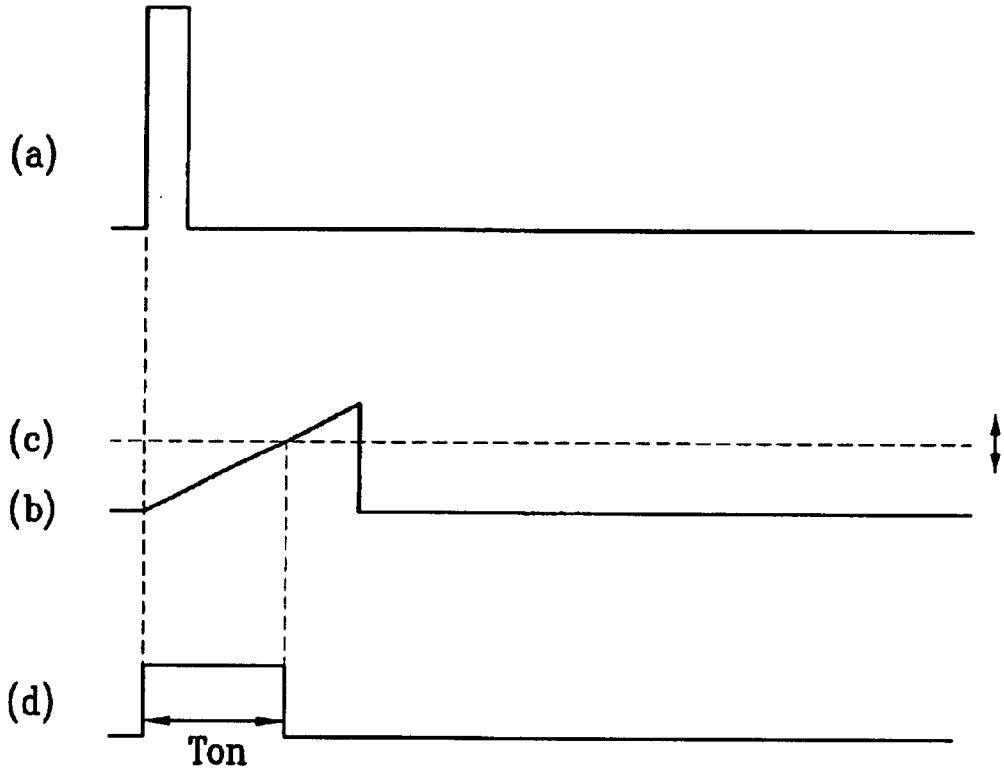
FIG. 4 illustrates a waveform diagram for an output process of a magnetron driving signal in an inverter circuit according to the present invention.

That is, as shown in FIG. 4, when the trigger signal (a) is outputted from the trigger circuit 60, the PWM controller 50 generates the triangular wave (b), and outputs the high signal (d) for a period in which the DC level (c) inputted from the integrator 40 is higher than the level of the triangular wave (b). At this time, a period having the high output signal from the PWM controller 50 is a time for turning on the switching device 4.

Accordingly, the inverter circuit of the microwave oven according to the present invention is different from a related art inverter circuit in that the inverter circuit according to the present invention directly receives the output signal of the input current detector 25, and controls the switching device 24 according to the comparison result after comparing the PWM signal outputted from the micom 20 with the output signal of the input current detector 25. That is, if the level of the PWM signal is lower than the level of the output signal of the input current detector 25, the integrator 40 increases the DC output level. Meanwhile, if the level of the output signal of the input current detector 25 is higher than the level of the PWM signal, the integrator 30 decreases the DC output level. Thus, it is possible to make the voltage level provided from the power source 31 corresponding to the level of the PWM signal outputted from the micom 20.

Furthermore, in case the output voltage of the input current detector 25 is higher than the preset reference voltage Vref, the inverter state detector 80 recognizes the inverter as being in a normal state. By informing the micom about the state of the inverter in a feedback method, the micom 20 recognizes the inverter as being operated in the normal state.

That is, the second comparator 81 of the inverter state detector 80 receives the output voltage of the input current detector 25 through the non-inversion (+) terminal, and outputs the high signal when the output voltage is higher the preset reference voltage Vref. Also, if the output of the second comparator 81 is in the high state, the photo coupler PC12 is turned on to output the high signal to a predetermined port of the micom 20. At this time, if the high signal is inputted through the predetermined port, the micom 20 recognizes 'inverter normal operation'.

As mentioned above, the inverter circuit of the microwave oven according to the present invention has the following advantages.

First, the PWM signal is outputted from the micom to control the inverter output, and the PWM signal is converted to the digital analog signal (D/A conversion), thereby decreasing the unit manufacturing cost of production.

Furthermore, the voltage level of the current inputted to the inverter is corresponding to the level of the PWM signal outputted from the micom, thereby controlling the output of the inverter correctly. Accordingly, it is possible to improve stability in the microwave oven according to the present invention.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An inverter circuit of a microwave oven, having a power source and a magnetron MGT, comprising:

a high voltage transformer HVT providing a high voltage to the magnetron;

a micom outputting a reference voltage preset by a user;

an input current detector converting a current provided from the power source to a voltage level;

a comparator comparing an output signal of the input current detector with the reference voltage;

an integrator increasing or decreasing a level of an output signal of the comparator;

a trigger circuit connected to the high voltage transformer, and generating a trigger signal;

a PWM controller receiving an output signal of the integrator and output signal of the trigger circuit, for controlling drive of the magnetron;

an inverter state detector for receiving the output signal of the input current detector, detecting whether a power provided from the power source is in a normal state and informing the micom about the state of the power.

2. The inverter circuit of claim 1, herein the inverter state detector includes:

a comparator comparing the output signal of the input current detector with the reference voltage; and a photo coupler being driven according to the output signal of the comparator.

3. The inverter circuit of claim 1, wherein the PWM controller generates a triangular wave signal by the trigger signal, and compares the level of the triangular wave signal with the level of the output signal of the integrator.

4. The inverter circuit of claim 3, wherein the PWM controller outputs a high level signal for a period in which the level of the output signal of the integral or is higher than the level of the triangular wave signal.

5. An inverter circuit of a microwave oven, having a power source and a magnetron MGT, comprising:

a micom outputting a reference voltage preset by a user;

an input current detector converting a current provided from the power source to a voltage level;

a comparator comparing an output signal of the input current detector with the reference voltage;

an integrator increasing or decreasing a level of an output signal of the comparator;

a trigger circuit connected to the high voltage transformer, and generating a trigger signal;

a PWM controller receiving an output signal of the integrator and a output signal of the trigger circuit, for controlling drive of the magnetron;

a D/A converter for converting the reference voltage outputted from the micom to an analog signal, and providing the analog signal to the comparator, wherein the D/A converter includes:

a photo coupler receiving the reference voltage from the micom;

first and second transistors being connected in series, and being turned on by the photo coupler; and a capacitor charging a voltage by the first and second transistors, and providing the voltage to the comparator.

6. An inverter circuit of a microwave oven, having a power source and a magnetron MGT, comprising:

a high voltage transformer having a primary side coil connected to the power source, and a secondary side coil connected to the magnetron;

a switching device between the power source and the primary side coil of the high voltage transformer;

a micom outputting a pulse width modulation PWM signal according to a preset reference voltage;

a D/A converter converting the PWM signal to an analog signal;

an input current detector converting a current provided from the power source to a voltage level;

a comparator comparing an output signal of the input current detector with an output signal of the D/A converter;

an integrator increasing or decreasing a DC level according to a comparison result in the comparator;

a trigger circuit connected to the primary side coil of the high voltage transformer, and generating a trigger signal; and a PWM controller generating a triangular wave signal internally according to the trigger signal, and controlling the switching device according to the triangular wave signal and the level of an output signal of the integrator, wherein the D/A converter includes:

a photo coupler receiving the PWM signal from the micom;

first and second transistors being connected in series, and being turned on by the photo coupler; and a capacitor charging a voltage by the first and second transistors, and providing the voltage to the comparator.

7. The inverter circuit of claim 6, wherein the PWM controller outputs a high level signal for a period in which the level of the output signal of the integrator is her than the level of the triangular wave signal.

8. The inverter circuit of claim 6, wherein the trigger circuit is connected to lower and upper sides of the primary side coil of the high voltage transformer.

9. The inverter circuit of claim 8, wherein the trigger circuit generates the trigger signal in case a voltage applied to the upper side of the primary side coil is higher than a voltage applied to the lower side of the primary side coil.

10. The inverter circuit of claim 6, wherein the integrator increases the DC level when the level of the output signal of the input current detector is lower the level of the output signal of the D/A converter, and decreases the DC level when the level of the output signal of the input current detector is higher than the level of the output of the D/A converter.

11. The inverter circuit of claim 6, further comprising a driver transmitting the output signal of the PWM controller to the switching device.

12. The inverter circuit of claim 6, further comprising a rectifying circuit rectifying the current provided from the power source, and outputting the rectified current to the primary side coil of the high voltage transformer.

13. An inverter of a microwave oven, having a power source and a magnetron MGT, comprising:

a high voltage transformer having a primary side coil connected to the power source, and a secondary side coil connected to the magnetron;

a switching device between the power source and the primary side coil of the high voltage transformer;

a micom outputting a pulse width modulation PWM signal according to a preset reference voltage;

a D/A converter converting the PWM signal to an analog signal;

an input current detector converting a current provided from the power source to a voltage level;

a comparator comparing an output signal of the input current detector with an output signal of the D/A converter;

an integrator increasing or decreasing a DC level according to a comparison result in the comparator;

a trigger circuit connected to the primary side coil of the high voltage transformer, and generating a trigger signal;

a PWM controller generating a triangular wave signal internally according to trigger signal, and controlling the switching device according to the triangular wave signal and the level of an output signal of the integrator; and an inverter state detector for receiving the output signal of the input current detector, detecting whether a power provided from the power source is in a normal state, and informing the micom about the state of the power.

14. The inverter circuit of claim 13, wherein the inverter state detector includes:

a comparator comparing the output signal of the input current detector with the preset reference voltage; and a photo coupler being driven by the output signal of the comparator.

15. An inverter circuit of a microwave oven, comprising:

a first detector which converts a power source signal into a first voltage signal;

a first comparator which compares the first voltage signal with a second voltage signal;

an integrator which integrates an output signal of the first comparator;

a PWM controller which generates a third signal for controlling drive of a magnetron based on the integrated signal and a trigger signal; and a second detector which detects a state of the power source signal base on the first voltage signal, and generates a state signal indicative of the state of the power source signal.

16. The circuit of claim 15, wherein the second voltage signal corresponds to a reference voltage preset by a user.

17. The circuit of claim 16, wherein the second voltage signal is output from a micom coupled to the second detector.

18. The circuit of claim 15, wherein the third signal controls transfer of voltage from a transformer to the magnetron.

19. The circuit of claim 18, wherein the trigger signal is generate by a trigger circuit coupled to the transformer.

20. The circuit of claim 15, wherein the second detector include:

a second comparator which compares the first voltage signal with a reference voltage and generates the state signal based on the comparison; and a photo coupler which inputs the state signal into a micom through a photocoupler.

21. The circuit of claim 20, wherein a first level of the state signal indicates a normal operational state and a second level of the state signal indicates a different operational state.

22. The circuit of claim 15, wherein the integrator increases a level of the output signal of the first comparator if the first comparator output has a first value, and decreases a level of the output signal of the comparator if the first comparator output has a second value.

23. The circuit of claim 22, wherein the first value is greater th the second value.

24. An inverter circuit of a microwave oven, comprising:

a converter which converts a digital signal indicative of a preset voltage into an analog signal;

a comparator which compares the analog signal to a power source signal; and a PWM controller which generates a control signal for controlling drive of a magnetron based on an output of the comparator and a trigger signal, wherein the D/A converter includes:

a photo coupler receiving the reference voltage from the micom;

first and second transistors connected in series and turned on by th photo coupler; and a capacitor charging a voltage by the first and second transistors which is proportional to the analog signal output to the comparator.

25. The circuit of 24, further comprising:

an integrator which integrates an output signal of the first comparator for input into the PWM controller.

26. The circuit of claim 24, wherein the digital signal of a preset voltage is designated by a user in association with a cooking operation of the oven.

* * * * *